United States Patent [19]

Sussman

[11] 4,446,972

[45] May 8, 1984

[54] STORAGE DEVICE FOR A PORTABLE HAIR DRYER OR THE LIKE

[76] Inventor: Howard Sussman, c/o F. F. Adams Inc., 700 N.W. 8th Ave., Fort Lauderdale, Fla. 33311

[21] Appl. No.: 326,819

[22] Filed: Mar. 12, 1982

[51] Int. Cl.[3] ..... A47F 7/00

[52] U.S. Cl. ..... 211/13; 211/60 R; D6/157; D6/188

[58] Field of Search ..... 211/13, 60 R, 88, 60 T, 211/126; 248/51, 52, 314, 311.2; D6/85, 157, 181, 188; 206/562, 563, 564; 242/96; 191/12.4, 125

[56] References Cited

U.S. PATENT DOCUMENTS

D. 162,224 2/1951 Ricard ..... D6/91
D. 250,348 11/1978 Frangiosa et al. ..... D6/85 X
D. 256,637 9/1980 Chiklis ..... D6/157 X
D. 260,830 9/1981 Trouba ..... D6/188 X
2,167,541 7/1939 Young ..... 191/12.4 X
3,964,708 6/1976 Reeves ..... 248/314 X

FOREIGN PATENT DOCUMENTS 515024 11/1939 United Kingdom ..... 248/51

*Primary Examiner*—Ramon S. Britts
*Assistant Examiner*—Robert W. Gibson, Jr.
*Attorney, Agent, or Firm*—Bauer & Amer

[57] ABSTRACT

A plastic injection molded device for storing a hair dryer and other hair-grooming devices, in which opposite laterally extending handles are provided for lifting and transporting the device, and also to serve as a convenient core-like support for wrapping the electrical cord of the dryer in helical turns thereabout.

1 Claim, 4 Drawing Figures

STORAGE DEVICE FOR A PORTABLE HAIR DRYER OR THE LIKE

The present invention relates generally to a convenience device for storing hair grooming items, and specifically a portable electrically operated hair dryer, and has as its major objective providing a neat appearance to these stored items, while also allowing facilitated daily use thereof.

Typically, a hair dryer is used daily, as are such hair grooming aids such as a comb, brush, barretts, various clips, and possibly even an electrically operated hair-curling iron. These items are currently stored, preparatory to use, in compartmentalized trays, which do no more than merely segregate these different items from each other.

Broadly, it is an object of the present invention to provide a storage device specifically for hair grooming aids, which does more than merely segregate said items, thus overcoming the foregoing and other shortcomings of the prior art. More particularly, it is an object to provide a hair grooming storage device in which there is an appropriate segregation of the different items, and also a noteworthy positioning of such items, such as the hair dryer, so that it is conveniently grasped and removed incident to use, and placed back in the device for storage.

The structure of the within storage device for particularly accommodating the hair dryer and which demonstrates objects and advantages of the present invention includes a body having a base and a laterally extending panel on the body in a spaced apart clearance position above the base. There is provided at least one cooperating pair of aligned openings located respectively in the base and the panel adjacent one side thereof which adapted to receive in projected relation therein the hair dryer front tube, such positioning being effective to maintain the hair dryer in a convenient vertical orientation preparatory to the use thereof. Completing the noteworthy structural aspects of the device are laterally extending hand grips on opposite sides of the base of the body, which grips are for convenient lifting and transportation of the device, and at least one said hand grip has opposite inwardly extending notches at the connection thereof with the base, whereby said notched hand grip is adapted to serve as a core for the convenient coiling thereabout of the hair dryer electrical cord in the stored condition of said hair dryer.

Figure 1:
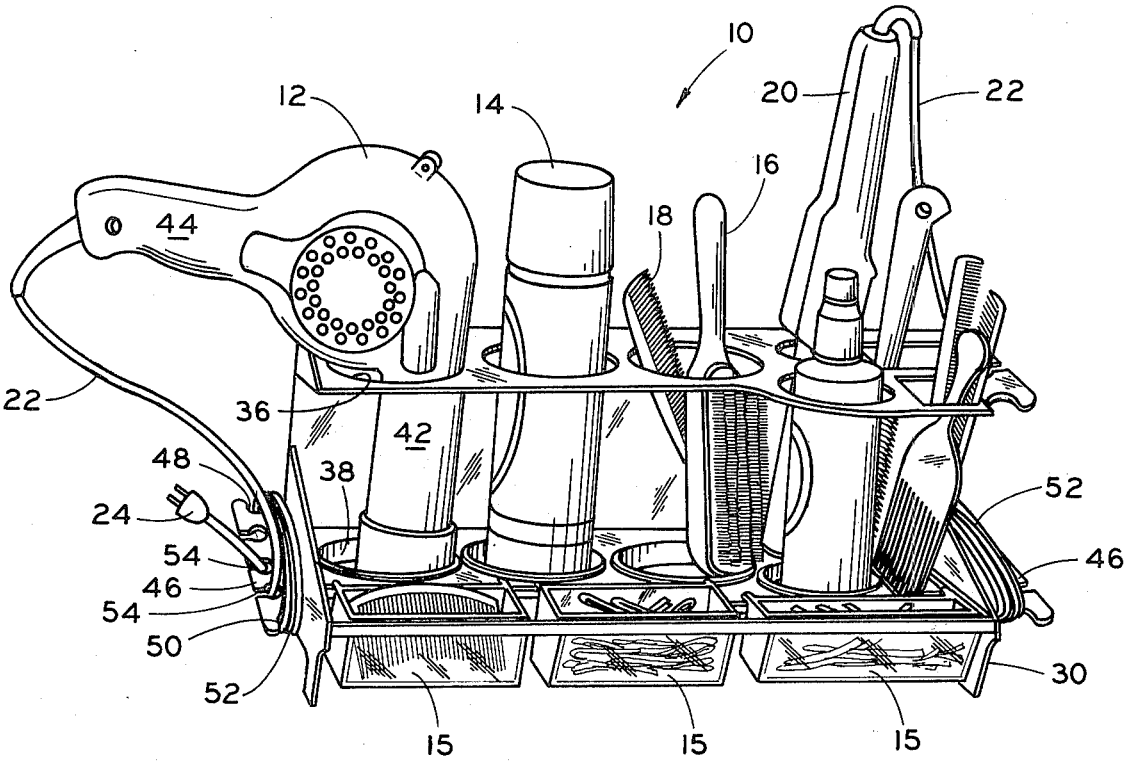
Figure 2:
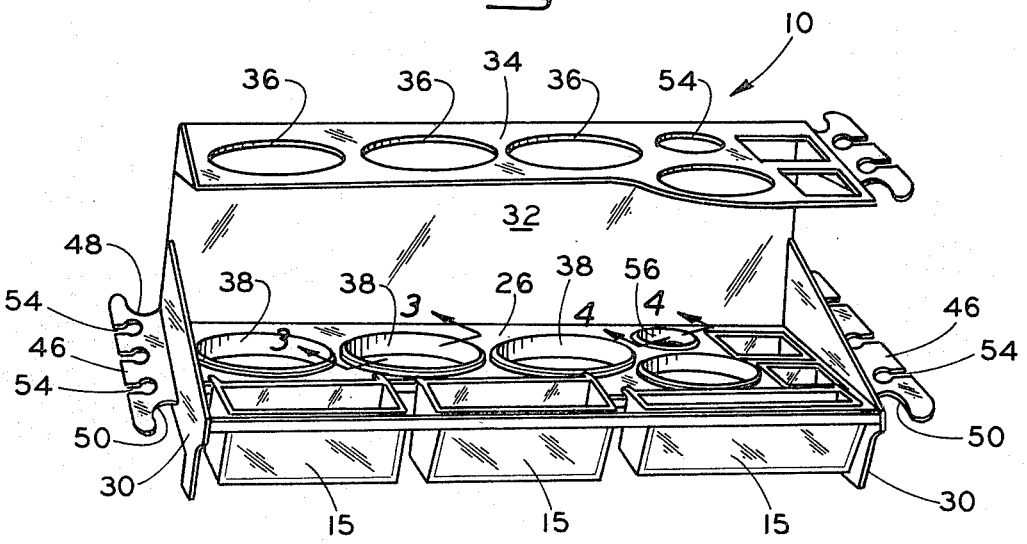
Figure 3:
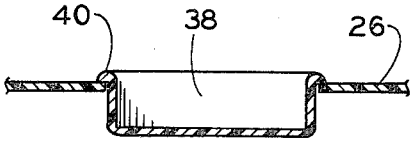
Figure 4:
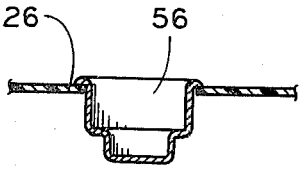

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a perspective view of a storage device according to the present invention containing specifically a portable hair dryer and also other products that would be typically stored therein;

FIG. 2, like FIG. 1, is similarly a perspective view with the products typically stored therein removed so as to better illustrate structural features of the device per se; and FIGS. 3 and 4 are partial sectional views respectively taken on lines 3—3 and 4—4 of FIG. 2 illustrating further structural details of the device.

The inventive device is generally designated 10 and will be understood to be an article of manufacture for more conveniently storing a portable hair dryer and other sundry products that are typically used for hair grooming and treatment. Thus, other products may be typically stored in the device 10 such as an aerosol can of hair spray 14, a hair brush and comb 15, 18 and other such items. Like the hair dryer 12, another of the additional items that might be stored in the device 10 that should specifically be noted is a hair curling iron 20. Both hair dryer 12 and curling iron 20 are mentioned because each is an electrically operated appliance and, thus, each includes an electrical cord 22 terminating in an electrical plug 24 for completing a connection to a wall outlet or the like, incident to use of the electrical appliance. Device 10 also includes trays 15 for holding bobby pins, barretts, hair clips and other typical small items that are used for hair grooming purposes.

When in use, the device 10 with the items stored therein as illustrated in FIG. 1 is appropriately sized so as to be placed on a toilet top. Also, however, it can be placed in an out-of-the-way location, such as in a cabinet or linen closet, although it has been designed to provide a neat enough appearance to be displayed on a vanity or bathroom countertop.

The size of a preferred commercial embodiment is $16\frac{3}{4}$ inches long, by $7\frac{1}{8}$ inches wide, by $6\frac{3}{8}$ inches high.

Although storage units for cosmetic and/or toiletry articles are already well known, such as for example the storage device of U.S. Pat. No. 4,118,084, the within device 10 is patentably distinguishable from these known devices in the respects which will now be specifically noted. More particularly, as is perhaps best illustrated in FIG. 2, the device 10 has a raised base 26 mounted in spanning relation between two side walls 28 and 30. Oriented vertically at the rear of the base 26 is a rear wall 32 which, at its upper end, has an overhanging laterally extending panel 34. Thus, the panel 34 is in a clearance position with respect to the base 26. This physical relationship is used to advantage in conveniently storing the hair dryer 12. More particularly, an opening 36 in panel 34 has an aligned relation with a cup-like member 38 that is disposed in an opening in the base 26, said member 38 being held in place by a peripheral lip 40, all as is clearly illustrated in the cross-sectional view of FIG. 3.

Thus, as best illustrated by progressive examination of FIGS. 1 and 2, the tubular front end of the hair dryer 12 which bounds the exit passage for the hot air produced by the dryer 12, is conveniently inserted through the opening 36 and into a supported position in the cup 38, thereby resulting in the dryer 12 being disposed in a vertically oriented position so that the handle 44 thereof is easily grasped incident to use of the dryer 12.

The structural feature which significantly contributes to the neat appearance, as well as to the convenience of using the device 10, is a laterally extending hand grip 46 for the device 10. Noteworthy structural features of the hand grip 46 include opposite inwardly extending notches 48 and 50 which enable the hand grip 46 to be conveniently used for support for the electrical cord 22 when wrapped, as clearly illustrated in FIG. 1, in coiled relation thereabout, as at 52.

Additionally, each opposite hand grip 46 also includes spaced notches 54, into one of which the free end of the electrical cord 22 is inserted and frictionally held in place, all as is clearly illustrated in FIG. 1.

Hand grip 46 on the other side of device 10, i.e., on the side on the right as viewed in FIG. 2, is constructed identically to hand grip 46 as just described in connection with the hair dryer 12. Thus, again as clearly illustrated in FIG. 1, the electrical cord 22 for the hair curling iron 20 is also conveniently wrapped, as at 52, about the hand grip 46, which is an integral part of the wall 30 located on the right side of the device 10.

Since the heating element of the curling iron 20 may be at an elevated temperature at the time that it is placed in the device 10 for storage, the upper opening 54 through which this applicance is projected is aligned with a cup 56 that is of metal construction material so that there is no damage caused to the cup 56.

It is, of course, important to note that as the name implies, the members 46 function as hand grips by which the device 10 can be conveniently gripped incident to moving the device 10 from one location to another. In addition, as already described, the hand grips 46 also serve an additional important function of supporting helical turns of the electrical cords 22 of the electrical appliances 12 and 20.

A latitude of modification, change and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. A convenience device for storing an electrically operated portable hair dryer of the type having an elongated cylindrical front tube bounding a hot air exiting passage and having an attached electrical cord terminating in a plug for use in completing an electrical connection thereto, said convenience device comprising a body having a base, a laterally extending panel on said body in a spaced apart clearance position above said base, at least one cooperating pair of aligned openings located respectively in said base and said panel adjacent one side thereof adapted to receive in projected relation therein said hair dryer front tube for maintaining said hair dryer in a convenient vertical orientation preparatory to the use thereof, and a laterally extending hand grip on each of the opposite sides of the base of said body provided for convenient lifting and transportation of said device, each said hand grip having a first pair of opposite inwardly extending notches at the connection thereof with said base so as to be adapted to serve as a core for the convenient coiling thereabout of said hair dryer electrical cord in the stored condition of said hair dryer, and additional plural spaced notches extending inwardly of the unattached remote edge of each said hand grip sized to engage in a friction fit therein said electrical cord, whereby after said electrical cord is coiled about said hand grip an appropriate one of said spaced notches is selected to receive said electrical cord at the connection thereof with said plug such that the friction fit thereof within said selected slot is effective to hold said electrical cord in its coiled storage condition about said hand grip.

* * * * *